US007215900B2

(12) United States Patent
Kurohata et al.

(10) Patent No.: US 7,215,900 B2
(45) Date of Patent: May 8, 2007

(54) IMAGE FORMING APPARATUS HAVING DEVICE FOR CHANGING PRINT CONDITION

(75) Inventors: Takao Kurohata, Hino (JP); Jun Yokobori, Sagamihara (JP); Takaaki Sakai, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 174 days.

(21) Appl. No.: 11/037,422

(22) Filed: Jan. 18, 2005

(65) Prior Publication Data

US 2005/0286924 A1 Dec. 29, 2005

(30) Foreign Application Priority Data

Jun. 25, 2004 (JP) ..... 2004-187558

(51) Int. Cl.
*G03G 15/00* (2006.01)

(52) U.S. Cl. ..... 399/82

(58) Field of Classification Search ..... None
See application file for complete search history.

(56) References Cited

U.S. PATENT DOCUMENTS

2004/0179222 A1* 9/2004 Sato et al. ..... 358/1.13

FOREIGN PATENT DOCUMENTS

JP 2002-099179 A 4/2002

* cited by examiner

*Primary Examiner*—Quana Grainger
(74) *Attorney, Agent, or Firm*—Frishauf, Holtz, Goodman & Chick, P.C.

(57) ABSTRACT

An image forming apparatus for forming an image based on image information on a recording medium, including: a storage section for storing print conditions for each of a plurality of pages of image information; a print condition setting section for setting print conditions in accordance with the print conditions stored in the storage section; a preprint section for preprinting in conformity to the print conditions having been set; an input section for inputting contents of a change in print condition for the page to be changed, selected from a plurality of pages after the preprinting; and a change section for changing the setting of the print conditions for the selected page to be changed, based on the contents of the change.

21 Claims, 15 Drawing Sheets

FIG. 5 ( A )
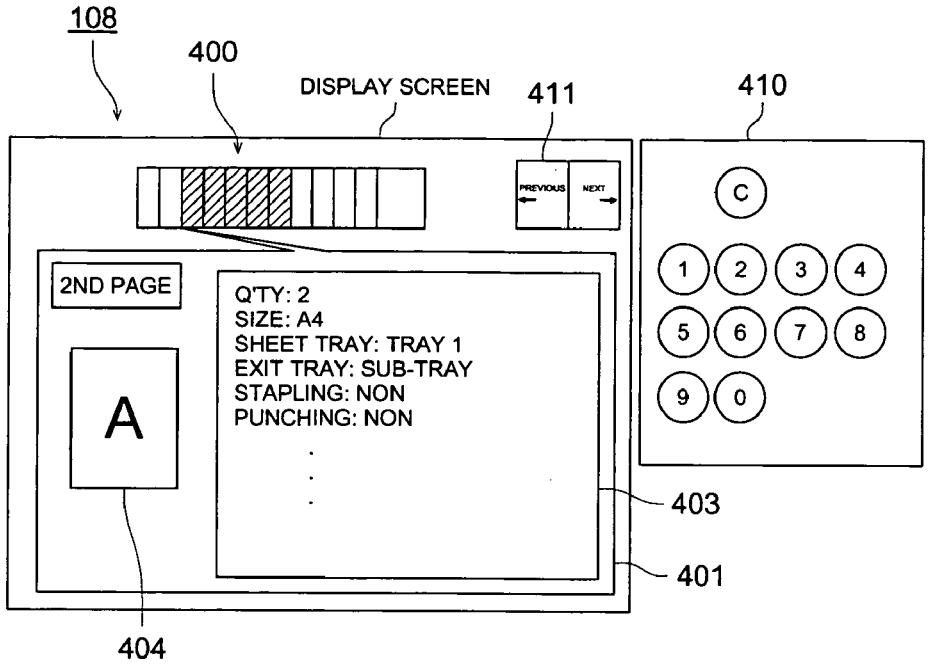
FIG. 5 ( B )
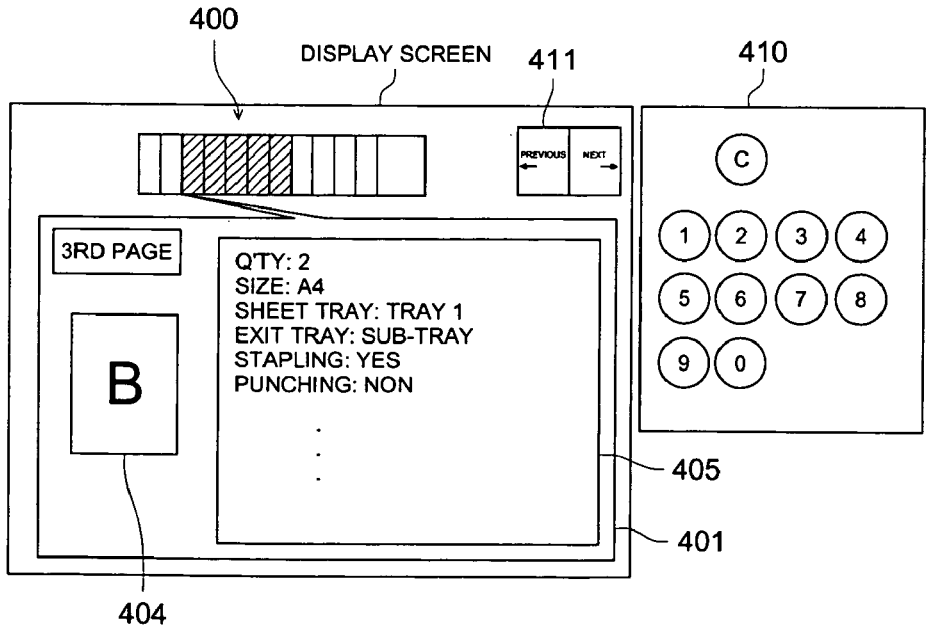

| SETTING / PAGE | APPLICATION ITEM OF FINISHING | SELECTION OF EXIT TRAY | PARTITION INFORMATION | NUMBER OF VOLUMES |
|---|---|---|---|---|
| 1 | PUNCHING: YES | SUB-TRAY | YES | 1 |
| 2 | ↑ | ↑ | YES | 2 |
| 3 | PUNCHING: NO | MAIN TRAY | YES | 3 |
| 4 | PUNCHING: YES | ↑ | YES | 4 |
| 5 | PUNCHING: NO | ↑ | YES | 5 |

FIG. 10 ( A )
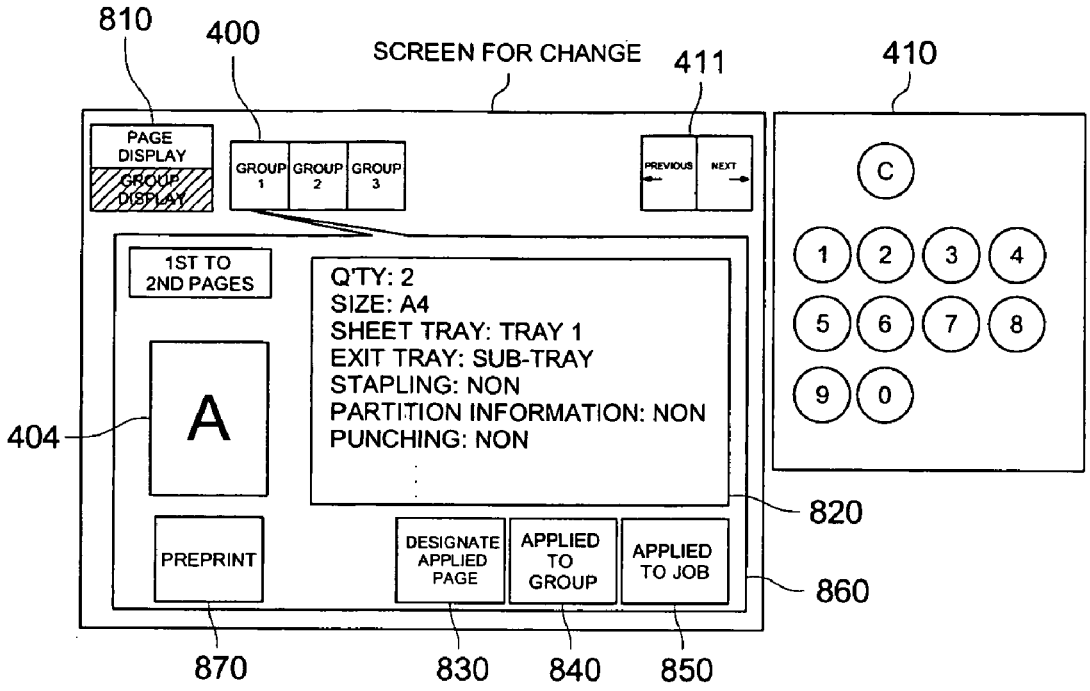
FIG. 10 ( B )
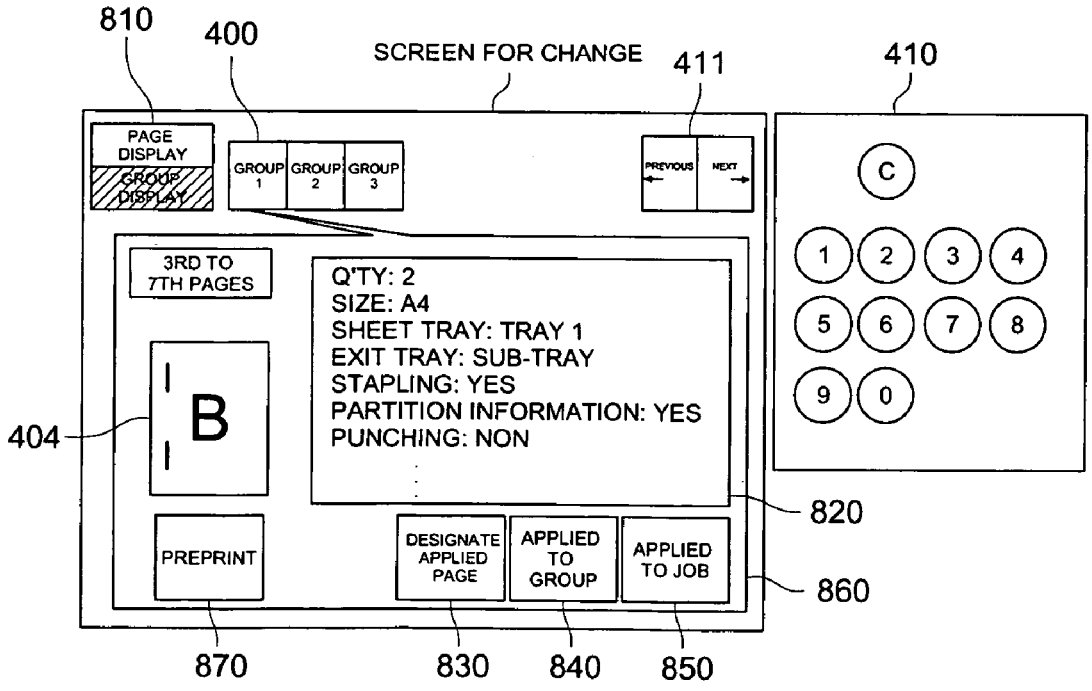

FIG. 11 (A)

| SETTING / PAGE | NUMBER OF VOLUMES | SHEET SIZE | SELECTION OF SHEET TRAY | SELECTION OF EXIT TRAY | APPLICATION OF STAPLING | PARTITION INFORMATION | APPLICATION OF PUNCHING |
|---|---|---|---|---|---|---|---|
| 1 | 2 | A4 | TRAY 1 | SUB-TRAY | NO | NO | NO |
| 2 | ↑ | ↑ | ↑ | ↑ | ↑ | ↑ | ↑ |
| 3 | ↑ | ↑ | ↑ | ↑ | YES | ↑ | ↑ |
| 4 | ↑ | ↑ | ↑ | ↑ | ↑ | ↑ | ↑ |
| 5 | ↑ | ↑ | ↑ | ↑ | ↑ | ↑ | ↑ |
| 6 | ↑ | ↑ | ↑ | ↑ | ↑ | ↑ | ↑ |
| 7 | ↑ | ↑ | ↑ | ↑ | ↑ | YES | ↑ |
| 8 | ↑ | ↑ | ↑ | ↑ | NO | NO | ↑ |
| 9 | ↑ | ↑ | ↑ | ↑ | ↑ | ↑ | ↑ |
| 10 | ↑ | ↑ | ↑ | ↑ | ↑ | ↑ | ↑ |
| 11 | ↑ | ↑ | ↑ | ↑ | ↑ | ↑ | ↑ |
| 12 | ↑ | ↑ | ↑ | ↑ | ↑ | ↑ | ↑ |

FIG. 11 (B)

| SETTING / PAGE | NUMBER OF VOLUMES | SHEET SIZE | SELECTION OF SHEET TRAY | SELECTION OF EXIT TRAY | APPLICATION OF STAPLING | PARTITION INFORMATION | APPLICATION OF PUNCHING |
|---|---|---|---|---|---|---|---|
| 1 | 2 | A4 | TRAY 1 | SUB-TRAY | NO | NO | NO |
| 2 | ↑ | ↑ | ↑ | ↑ | ↑ | ↑ | YES |
| 3 | ↑ | ↑ | ↑ | ↑ | YES | ↑ | NO |
| 4 | ↑ | ↑ | ↑ | ↑ | ↑ | ↑ | ↑ |
| 5 | ↑ | ↑ | ↑ | ↑ | ↑ | ↑ | ↑ |
| 6 | ↑ | ↑ | ↑ | ↑ | ↑ | ↑ | ↑ |
| 7 | ↑ | ↑ | ↑ | ↑ | ↑ | YES | ↑ |
| 8 | ↑ | ↑ | ↑ | ↑ | NO | NO | ↑ |
| 9 | ↑ | ↑ | ↑ | ↑ | ↑ | ↑ | ↑ |
| 10 | ↑ | ↑ | ↑ | ↑ | ↑ | ↑ | ↑ |
| 11 | ↑ | ↑ | ↑ | ↑ | ↑ | ↑ | ↑ |
| 12 | ↑ | ↑ | ↑ | ↑ | ↑ | ↑ | ↑ |

FIG. 12 ( A )

| SETTING / PAGE | NUMBER OF VOLUMES | SHEET SIZE | SELECTION OF SHEET TRAY | SELECTION OF EXIT TRAY | APPLICATION OF STAPLING | PARTITION INFORMATION | APPLICATION OF PUNCHING |
|---|---|---|---|---|---|---|---|
| 1 | 2 | A4 | TRAY 1 | SUB-TRAY | NO | NO | YES |
| 2 | ↑ | ↑ | ↑ | ↑ | ↑ | ↑ | ↑ |
| 3 | ↑ | ↑ | ↑ | ↑ | ↑ | ↑ | ↑ |
| 4 | ↑ | ↑ | ↑ | ↑ | YES | ↑ | NO |
| 5 | ↑ | ↑ | ↑ | ↑ | ↑ | ↑ | ↑ |
| 6 | ↑ | ↑ | ↑ | ↑ | ↑ | ↑ | ↑ |
| 7 | ↑ | ↑ | ↑ | ↑ | ↑ | YES | ↑ |
| 8 | ↑ | ↑ | ↑ | ↑ | NO | NO | ↑ |
| 9 | ↑ | ↑ | ↑ | ↑ | ↑ | ↑ | ↑ |
| 10 | ↑ | ↑ | ↑ | ↑ | ↑ | ↑ | ↑ |
| 11 | ↑ | ↑ | ↑ | ↑ | ↑ | ↑ | ↑ |
| 12 | ↑ | ↑ | ↑ | ↑ | ↑ | ↑ | ↑ |

FIG. 12 ( B )

| SETTING / PAGE | NUMBER OF VOLUMES | SHEET SIZE | SELECTION OF SHEET TRAY | SELECTION OF EXIT TRAY | APPLICATION OF STAPLING | PARTITION INFORMATION | APPLICATION OF PUNCHING |
|---|---|---|---|---|---|---|---|
| 1 | 2 | A4 | TRAY 1 | SUB-TRAY | NO | NO | YES |
| 2 | ↑ | ↑ | ↑ | ↑ | ↑ | ↑ | ↑ |
| 3 | ↑ | ↑ | ↑ | ↑ | YES | ↑ | NO |
| 4 | ↑ | ↑ | ↑ | ↑ | ↑ | ↑ | ↑ |
| 5 | ↑ | ↑ | ↑ | ↑ | ↑ | ↑ | ↑ |
| 6 | ↑ | ↑ | ↑ | ↑ | ↑ | ↑ | ↑ |
| 7 | ↑ | ↑ | ↑ | ↑ | ↑ | YES | ↑ |
| 8 | ↑ | ↑ | ↑ | ↑ | NO | NO | ↑ |
| 9 | ↑ | ↑ | ↑ | ↑ | ↑ | ↑ | ↑ |
| 10 | ↑ | ↑ | ↑ | ↑ | ↑ | ↑ | ↑ |
| 11 | ↑ | ↑ | ↑ | ↑ | ↑ | ↑ | ↑ |
| 12 | ↑ | ↑ | ↑ | ↑ | ↑ | ↑ | ↑ |

FIG. 13 (A)

| SETTING / PAGE | NUMBER OF VOLUMES | SHEET SIZE | SELECTION OF SHEET TRAY | SELECTION OF EXIT TRAY | APPLICATION OF STAPLING | PARTITION INFORMATION | APPLICATION OF PUNCHING |
|---|---|---|---|---|---|---|---|
| 1 | 2 | A4 | TRAY 1 | SUB-TRAY | NO | NO | YES |
| 2 | ↑ | ↑ | ↑ | ↑ | ↑ | ↑ | ↑ |
| 3 | ↑ | ↑ | ↑ | ↑ | ↑ | ↑ | ↑ |
| 4 | ↑ | ↑ | ↑ | ↑ | ↑ | ↑ | ↑ |
| 5 | ↑ | ↑ | ↑ | ↑ | ↑ | ↑ | ↑ |
| 6 | ↑ | ↑ | ↑ | ↑ | ↑ | ↑ | ↑ |
| 7 | ↑ | ↑ | ↑ | ↑ | ↑ | ↑ | ↑ |
| 8 | ↑ | ↑ | ↑ | ↑ | ↑ | ↑ | ↑ |
| 9 | ↑ | ↑ | ↑ | ↑ | ↑ | ↑ | ↑ |
| 10 | ↑ | ↑ | ↑ | ↑ | ↑ | ↑ | ↑ |
| 11 | ↑ | ↑ | ↑ | ↑ | ↑ | ↑ | ↑ |
| 12 | ↑ | ↑ | ↑ | ↑ | ↑ | ↑ | ↑ |

FIG. 13 (B)

| SETTING / PAGE | NUMBER OF VOLUMES | SHEET SIZE | SELECTION OF SHEET TRAY | SELECTION OF EXIT TRAY | APPLICATION OF STAPLING | PARTITION INFORMATION | APPLICATION OF PUNCHING |
|---|---|---|---|---|---|---|---|
| 1 | 2 | A4 | TRAY 1 | SUB-TRAY | NO | NO | YES |
| 2 | ↑ | ↑ | ↑ | ↑ | ↑ | ↑ | ↑ |
| 3 | ↑ | ↑ | ↑ | ↑ | YES | ↑ | NO |
| 4 | ↑ | ↑ | ↑ | ↑ | ↑ | ↑ | ↑ |
| 5 | ↑ | ↑ | ↑ | ↑ | ↑ | ↑ | ↑ |
| 6 | ↑ | ↑ | ↑ | ↑ | ↑ | ↑ | ↑ |
| 7 | ↑ | ↑ | ↑ | ↑ | ↑ | YES | ↑ |
| 8 | ↑ | ↑ | ↑ | ↑ | NO | NO | ↑ |
| 9 | ↑ | ↑ | ↑ | ↑ | ↑ | ↑ | ↑ |
| 10 | ↑ | ↑ | ↑ | ↑ | ↑ | ↑ | ↑ |
| 11 | ↑ | ↑ | ↑ | ↑ | ↑ | ↑ | ↑ |
| 12 | ↑ | ↑ | ↑ | ↑ | ↑ | ↑ | ↑ |

FIG. 14 (A)

| SETTING / PAGE | NUMBER OF VOLUMES | SHEET SIZE | SELECTION OF SHEET TRAY | SELECTION OF EXIT TRAY | APPLICATION OF STAPLING | PARTITION INFORMATION | APPLICATION OF PUNCHING |
|---|---|---|---|---|---|---|---|
| 1 | 2 | A4 | TRAY 1 | SUB-TRAY | NO | NO | YES |
| 2 | ↑ | ↑ | ↑ | ↑ | ↑ | ↑ | ↑ |
| 3 | ↑ | ↑ | ↑ | ↑ | YES | ↑ | NO |
| 4 | ↑ | ↑ | ↑ | ↑ | ↑ | ↑ | ↑ |
| 5 | ↑ | ↑ | ↑ | ↑ | ↑ | ↑ | ↑ |
| 6 | ↑ | ↑ | ↑ | ↑ | ↑ | ↑ | ↑ |
| 7 | ↑ | ↑ | ↑ | ↑ | ↑ | YES | ↑ |
| 8 | ↑ | ↑ | ↑ | ↑ | NO | NO | ↑ |
| 9 | ↑ | ↑ | ↑ | ↑ | ↑ | ↑ | ↑ |
| 10 | ↑ | ↑ | ↑ | ↑ | ↑ | ↑ | ↑ |
| 11 | ↑ | ↑ | ↑ | ↑ | ↑ | ↑ | YES |
| 12 | ↑ | ↑ | ↑ | ↑ | ↑ | ↑ | ↑ |

FIG. 14 (B)

| SETTING / PAGE | NUMBER OF VOLUMES | SHEET SIZE | SELECTION OF SHEET TRAY | SELECTION OF EXIT TRAY | APPLICATION OF STAPLING | PARTITION INFORMATION | APPLICATION OF PUNCHING |
|---|---|---|---|---|---|---|---|
| 1 | 2 | A4 | TRAY 1 | SUB-TRAY | NO | NO | YES |
| 2 | ↑ | ↑ | ↑ | ↑ | ↑ | ↑ | ↑ |
| 3 | ↑ | ↑ | ↑ | ↑ | ↑ | ↑ | ↑ |
| 4 | ↑ | ↑ | ↑ | ↑ | ↑ | ↑ | ↑ |
| 5 | ↑ | ↑ | ↑ | ↑ | ↑ | ↑ | ↑ |
| 6 | ↑ | ↑ | ↑ | ↑ | ↑ | ↑ | ↑ |
| 7 | ↑ | ↑ | ↑ | ↑ | ↑ | NO | ↑ |
| 8 | ↑ | ↑ | ↑ | ↑ | ↑ | NO | ↑ |
| 9 | ↑ | ↑ | ↑ | ↑ | ↑ | ↑ | ↑ |
| 10 | ↑ | ↑ | ↑ | ↑ | ↑ | ↑ | ↑ |
| 11 | ↑ | ↑ | ↑ | ↑ | ↑ | ↑ | ↑ |
| 12 | ↑ | ↑ | ↑ | ↑ | ↑ | ↑ | ↑ |

IMAGE FORMING APPARATUS HAVING DEVICE FOR CHANGING PRINT CONDITION

BACKGROUND OF THE INVENTION

The present invention relates to an image forming apparatus for forming an image on a recording medium.

With an increasing degree of sophistication in the process of printing carried out in the image forming apparatus in recent years, print condition is coming to be set and managed for each page of the recording paper to be inputted (see Patent Document 1 referred to hereinbelow). In such an image forming apparatus, the print condition is set for each page and an image is formed according to the print condition for each page, whereby a great variety of high-quality outputs are achieved.

In the image forming apparatus, the conditions of finishing, e.g. stapling and punching, in addition to the image quality setting conditions are set for each page as print condition. Such finishing conditions are getting more and more highly functional and complicated, with an increasing degree of sophistication in the process of printing. Further, in addition to the process of finishing, the image forming conditions includes such high-functional processing as addition of page information, e.g. pagination and layout processing, e.g. recording of images of plural documents on a sheet of recording paper.

(Patent Document 1): Official Gazette of Japanese Patent Publication Tokkai 2002-99179.

However, an increasing degree of function and complexity in print condition is accompanied by setting errors. In the aforementioned background prior art, resetting requires much labor and time when a setting error has occurred. In other words, the operator has to repeat the setting in conformity to the predetermined procedure from the beginning for each page, and to perform confirmation and correction again.

Especially, when inputting complicated print condition covering a large amount of pages, much labor and time are needed and a setting error may occur. This will cause a high degree of operator effort and concentration.

Further, to avoid faulty image formation outputs caused by such setting errors, preprinting can be performed. In the process of the preprinting, the pages for each job are printed out and the print condition set by an operator is confirmed.

However, even if a preprint is carried out, when the print condition is required to be changed, similar to the problem as mentioned above, there remains the problem that resetting requires much labor and time.

Thus, it is important to develop an image forming apparatus capable of simple resetting of the print condition.

SUMMARY OF THE INVENTION

In view of the prior art described above, it is an object of the present invention to provide an image forming apparatus allowing simple resetting of the print condition.

The above object will be achieved by one of Structures (1) or (2).

Structure (1): An image forming apparatus for forming an image based on image information on a recording medium, comprising: (a) a storage section for storing a print condition for each of a plurality of pages of image information; (b) a print condition setting section for setting a print condition in response to the print condition stored in the storage section; (c) a preprint section for preprinting in accordance with the print condition which has been set; (d) an input section for inputting contents of a change in the print condition for a page to be changed, selected from the plurality of pages after the preprinting; and (e) a change section for changing a setting of the print condition for the selected page to be changed, based on the contents of the change.

Structure (2): An image forming apparatus for forming an image based on image information on a recording medium, including:

(a) a storage section for storing a print condition for each of a plurality of pages of image information;

(b) a print condition setting section for setting a print condition in accordance with the print condition stored in the storage section;

(c) a selection section for selecting plural pages having the same print condition as one group;

(d) an input section for inputting contents of a change in the print condition for the group selected by the selection sections; and (e) a change section for changing a setting of the print condition for the selected page to be changed, based on the change.

The image forming apparatus of the Structure (1) is an image forming apparatus wherein, when image information constituted by a plurality of pages is to be formed on a recording medium, the print condition of the image information is stored for each page and an image is formed for each page based on the print condition, and the aforementioned print condition contains finishing information of the finisher. This image forming apparatus includes: a preprint means for preprinting of the aforementioned image; a display and change means for displaying the print condition of the page to be changed, which is selected out of the aforementioned plural pages, after termination of the aforementioned preprinting, and for changing the print condition; an operation section for setting such selection and change.

BRIEF DESCRIPTION OF THE DRAWINGS

FIGS. 5(A) and 5(B) are drawings of a display screen for showing the print condition for each page as an embodiment of the present invention;

FIGS. 10(A) and 10(B) are drawings of a change screen for changing the print condition for each group as an embodiment of the present invention;

FIGS. 11(A) and 11(B) are drawings of exemplifying a change of individual print condition as an embodiment of the present invention (Part 1);

FIGS. 12(A) and 12(B) are drawings of exemplifying a change of individual print condition as an embodiment of the present invention (Part 2);

FIGS. 13(A) and 13(B) are drawings of exemplifying a change of individual print condition as an embodiment of the present invention (Part 3); and FIGS. 14(A) and 14(B) are drawings of exemplifying a change of individual print condition as an embodiment of the present invention (Part 4)

DETAILED DESCRIPTION OF THE PREFERRED EMBODIMENT

Referring to the accompanying drawings, the following describes an image forming apparatus as the best mode of embodiment of the present invention, without the present invention being restricted thereto.

Figure 2:
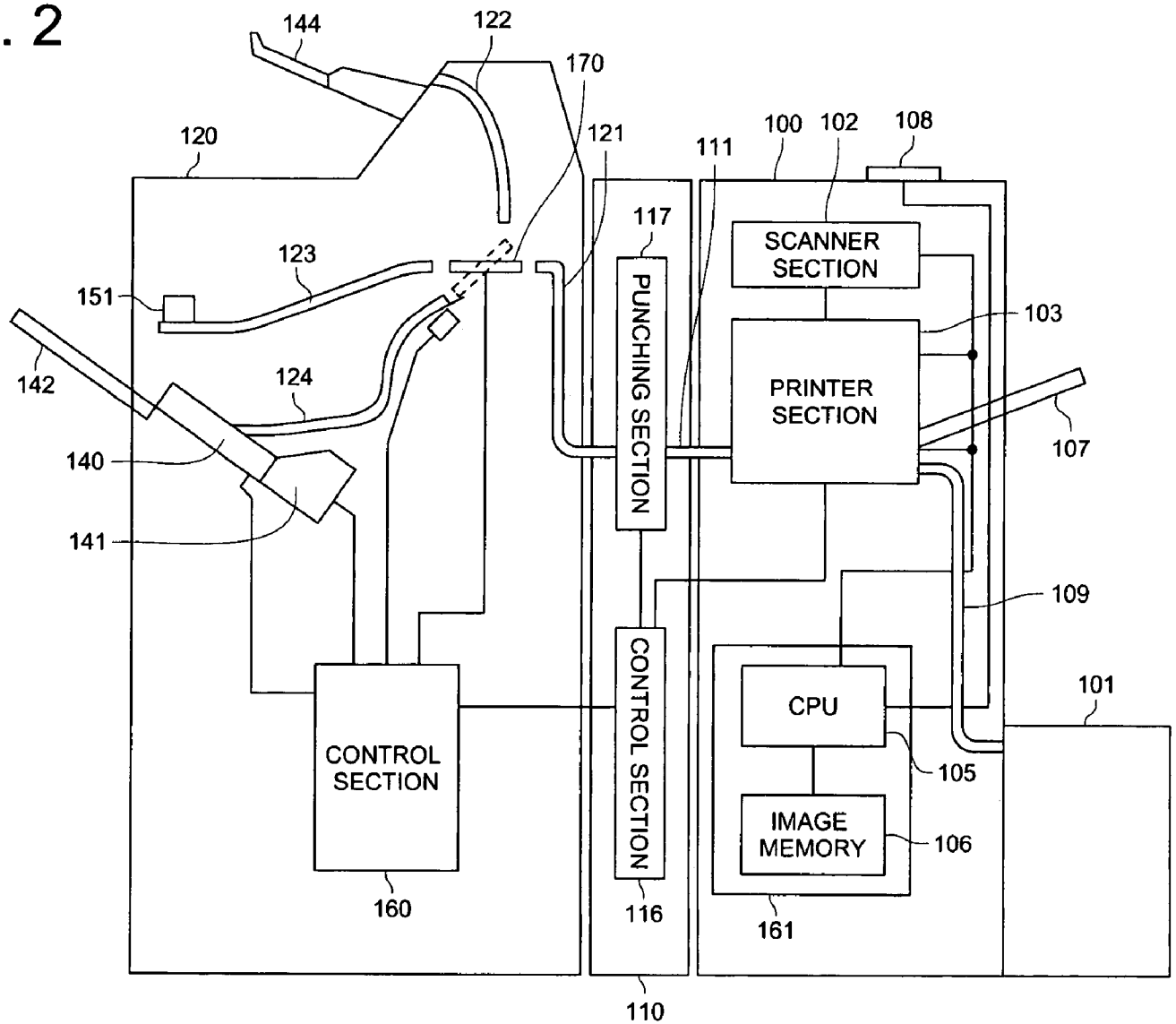
FIG. 2 is a drawing represents the overall configuration of an image forming apparatus.

The overall configuration of the image forming apparatus of the present invention will be described first. FIG. 2 is a drawing representing the overall configuration of the image forming apparatus. The image forming apparatus includes a digital multifunctional machine 100, a punching unit 110 and a finishing apparatus 120. The digital multifunctional machine 100 has a main unit and a sheet tray 101, and the main unit includes a scanner section 102 as an example of the scanning means, a printer section 103 as part of the image forming means, a sheet tray 107, conveyance paths 109 and 111, a CPU 105 constituting a control section 161 and an image memory 106. Further, the punching unit 110 for punching work includes a punching section 117 and a control unit 116 for controlling the punching section 117. The finishing apparatus 120, conveyance paths 121 through 124, a gate 170, a shift section 151, stacking section 140, a stapling section 141, a main tray 142 constituting an exit tray, a sub-tray 144 and a control section 160. The punching unit 110 and finishing apparatus 120 form a finishing section, and constitutes an image forming apparatus, together with the printer section 103.

An operation section 108 is provided with a touch panel such as an LCD (liquid crystal display) for setting, displaying and changing the print condition, and a ten-keypad. The operation section 108 also includes the setting means for selecting and changing the print condition after preprint means to be described later.

The operation section 108 also includes a read start button for instructing the start of scanning of a document by a scanner section 102, an image formation button for instructing the start of image formation and a preprint start button for instructing the start of preprinting.

The print condition of the present invention refers to the condition for outputting the image information including plural pages at the time of image formation. The condition includes finishing, information addition, layout, duplex and simplex copying and an exit tray selection. To put it more specifically, finishing includes stapling, punching and selection of exit tray. Information addition includes pagination for each page. Layout includes layout of one-page output, e.g. so called N-in-one processing for outputting N pages of document images in one page. That is, this implies a processing of multi-pages per one side of a sheet.

The scanner section 102 scans the image of the document mounted on the platen glass page by page. Based on the print condition, the printer section 103 inputs the recording paper as a recording medium supplied from the conveyance path 109 of the sheet tray 101 or sheet tray 107, and transfers the image scanned by the scanner section 102 onto the recording paper, whereby an image is formed. Further, the recording paper where an image is formed by the printer section 103 is supplied to the punching unit 110 from the printer section 103 through the conveyance path 111.

Based on the print condition, the punching unit 110 uses the punching section 117 to produce a punched hole on the recording paper from the digital multifunctional machine 100. Then the finishing apparatus 120 captures the recording paper ejected from the punching unit 110 and puts it onto the conveyance path 121. Then it ejects the paper to the main tray 142 through the gate 170 or to the sub-tray 144. Alternatively, the paper is subjected to shift processing by the shift section 151 in the finishing process when ejecting it to the main tray, or is subjected to stapling process by the stapling section 141. Depending on the processes selected from among these alternatives, one of conveyance paths 122 through 124 is selected.

When stapling is performed in the finishing process, the stacking section 140 of the finishing apparatus 120 stacks a plurality of sheets of recording paper. Similarly, the stacking section 140 of the finishing apparatus 120 drives staples into the sheets of recording paper stacked on the stacking section 140 in response to the instruction from the control section 160, and binds the sheets.

The recording paper conveyed onto the stacking section 140 from the input section 124 slides down to the side-stitching stopper by its own weight and stops there. This allows a plurality of sheets of paper in the stacking section 140 to be aligned in the direction of conveyance, and alignment in the direction of conveyance is ensured. Further, alignment across the width of recording paper orthogonal to that direction is provided when the recording paper is tapped by a tapping mechanism (not illustrated) orthogonal to the paper surface in response to the instruction from the control section 160. A plurality of sheets of recording paper having been subjected to stapling process has its trailing edge held by the ejection claw of the ejection belt inside the stacking section 140, and is pushed upward. Then the paper is ejected into the main tray 142.

In the shift section 151, the recording paper of straight ejection put into the conveyance path 123 from the conveyance path 121 through the gate 170 is displaced in the direction at right angles with the feed direction of recording paper and is ejected into the main tray 142. Then the sheets of recording paper with different contents copied thereon can be classified on the main tray 142.

The sub-tray 144 serves as a receiving tray after the recording paper has been ejected onto the conveyance path 122. The sub-tray 144 is located on the upper row of the finishing apparatus 120. The ejected recording paper can be easily taken out from the top of the finishing apparatus 120.

Figure 3:
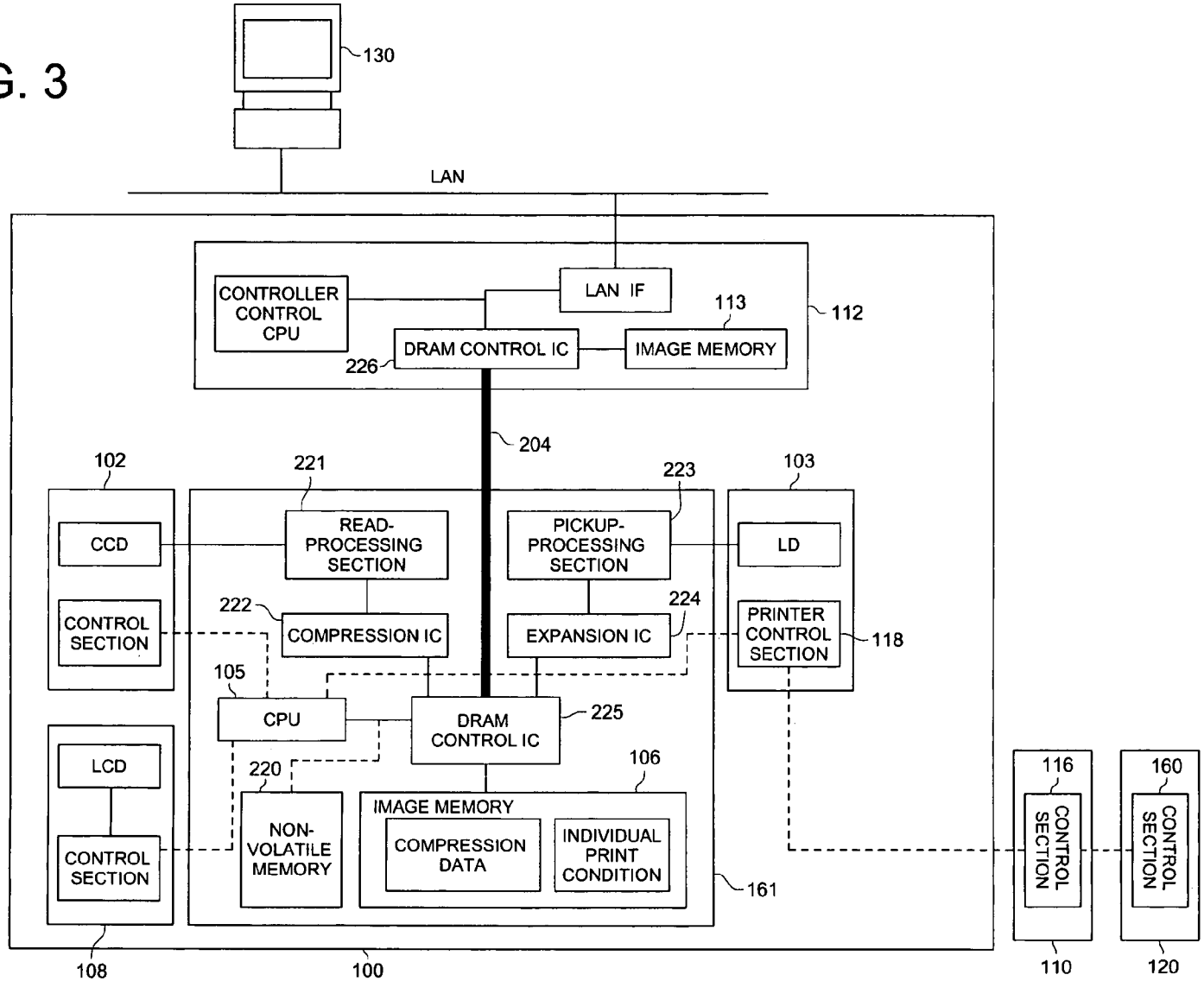
FIG. 3 is a drawing of the configuration of an image forming apparatus mainly showing the control section of a digital multifunctional machine.

FIG. 3 is a functional block diagram representing the flow of the image information centering on the control section 161 of the digital multifunctional machine 100 and print condition. When image information is scanned from the scanner section 102, the image information of the document is scanned by the CCD (charge coupled device). After having been read by the read-processing section 221 of the control section 161, the image is compressed by the compression IC 222 and is stored in an image memory 106. The print condition of the image information can be inputted from the operation section 108 in any one of the units of job, plural page or a single page, and is similarly stored in the image memory 106.

When image information is read from a terminal 130 via the LAN (Local Area Network), the image information is read into the image memory 113 of the image processing section 112, and is then read into the image memory 106 of the control section 161 through the bus 204. After that, the image information of the image memory 106 is sent to the compression IC 222 through the DRAM control IC 225. Having been compressed there, the image information is again stored in the image memory 106.

The image memories 106 and 113 are constituted by a DRAM (Dynamic Random Access Memory) and are controlled by the DRAM control ICs 225 and 226 for representing the storage information.

The compressed data of the image information stored in the image-memory 106 is sent to the expansion IC 224 through the DRAM control IC 225 and is expanded. Then it is sent, for example, to the LD (Laser Diode) of the printer section 103 from the pickup-processing section 223 and image formation is carried out. The print condition of the image memory 106 is send to the printer control section 118 of the printer section 103 through the CPU 105. Based on this print condition, the printer control section 118 controls the printer, succeeding punching unit 110 and finishing apparatus 120.

When a copy image is formed from a document having a plurality of pages in the image forming apparatus, the document having a plurality of pages is divided into a plurality of groups, and print condition is set by the setting means for each group. When the read start button has been pressed, the document image is scanned from each group by the scanner section 102 as a reading means and the document image is stored in the image memory 106. When the image formation start button has been pressed, formation of copy images for each group according to the print condition set for each group is started by the printer section 103 as an image forming means, and this processing is applied to all the groups.

Figure 1:
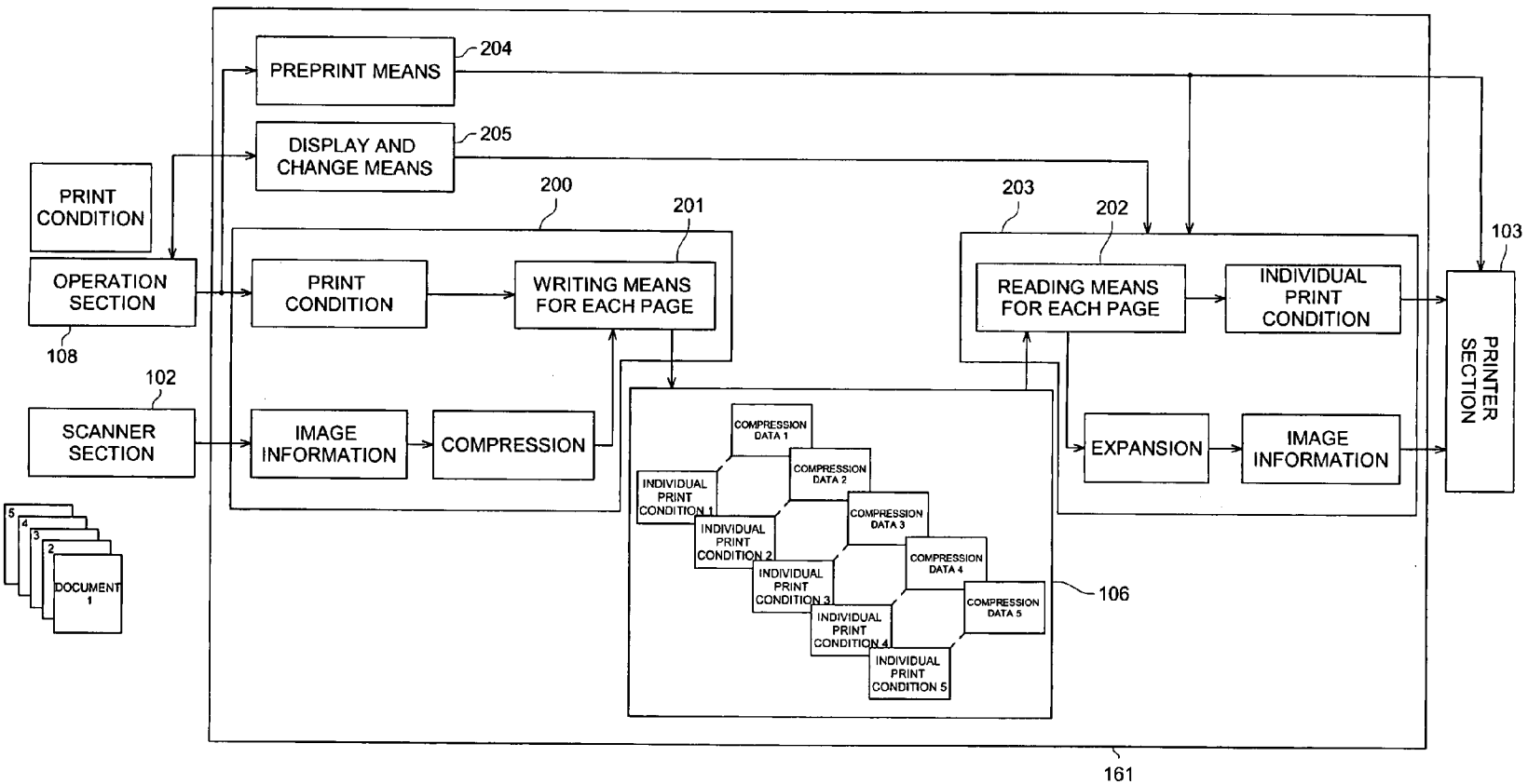
FIG. 1 is a block diagram represents the control section of a digital multifunctional machine.

FIG. 1 is a block diagram representation the functions of writing the image information and print condition into the image memory 106 and reading it therefrom. The control section 161 includes a reading means 200, an image memory 106, a pickup means 203, a preprinting means 204 and a display and change means 205. The hardware constituting the reading means 200, pickup means 203, preprinting means 204 and display and change means 205 includes a CPU 105, non-volatile memory 220, DRAM control IC 225, read-processing section 221, compression IC 222, expansion IC 224 and pickup-processing section 223.

When the operation section 108 reads a group of image information, namely, documents 1 through 5 in FIG. 1, the print condition is set by the operator. This print condition is set for each job, for a plurality of pages constituting a group, or for each page. The control section 161 allows the reading means 200 to read the print condition and the image information of the documents 1 through 5 into the image memory 106. The image information of the documents 1 through 5 is compressed by the compression IC 222. From the print condition for each inputted job, for a plurality of pages or for each page, the page writing means 201 generates each print condition for each page of the compressed image information. Each print condition is associated with the compressed data of the corresponding page by linking, and each print condition and compressed data are stored in the image memory 106. The page writing means 201 repeats this procedure until a group of the image information is stored into the image memory 106. In FIG. 1, the print condition and image information are read from the operation section 108 and scanner section 102, as described above. However, when the print condition and image information are inputted from the terminal 130, it is read through the LAN (Local Area Network) from the terminal 130 shown in FIG. 3. Then the image information and print condition are read into the image memory 113 and are then read into the image memory 106 of the control section 161 through the bus 240. The print condition read into the image processing section 112 can be inputted for each job, for a plurality of pages or for each page.

Each print condition and compressed data stored in the image memory 106 are picked up by the pickup means 203. In the page reading means 202 of the pickup means 203, the compressed data and each print condition associated therewith are as a pair picked up sequentially. The compressed data is expanded by the expansion IC 224 and is sent to the printer section 103 as image information, together with the corresponding each print condition.

Based on the page-designation from the operation section 108, the display and change means 205 allows the pickup means 203 to pick up the designated individual print condition in the image memory 106 so that it is displayed on the operation section 108. The display and change means 205 allows the reading means 200 to write on the relevant of the image memory 106 the print condition change information with the page-designated by the operation section 108. Here the display and change means 205 has a page change means, group change means and job change means, wherein in the case of pickup, pickup is performed for each page or group, in response to the instruction from the switching means 810, which will be described later, of the operation section 108; and in the case of writing, writing is performed for each of the designated page, group and job, in response to the instruction given by a page application means 830, which will be described later, group application means 840 and job application means 850 of the operation section 108.

The preprint means 204 performs preprinting in response to the instruction of the button from the operation section 108. In the preprinting process, the compressed data of each print condition and image information in units of job stored in the image memory 106 is read by the page reading means 202. After the image information has been expanded, it is sent to the printer section 103 and is printed on a printer. Upon termination of the outputting on the printer, the preprint means 204 sends the termination signal to the operation section 108 by a means not illustrated in the drawing. Further, without being restricted to the job unit, preprinting can also be performed for a specific group or page alone.

Figure 4:
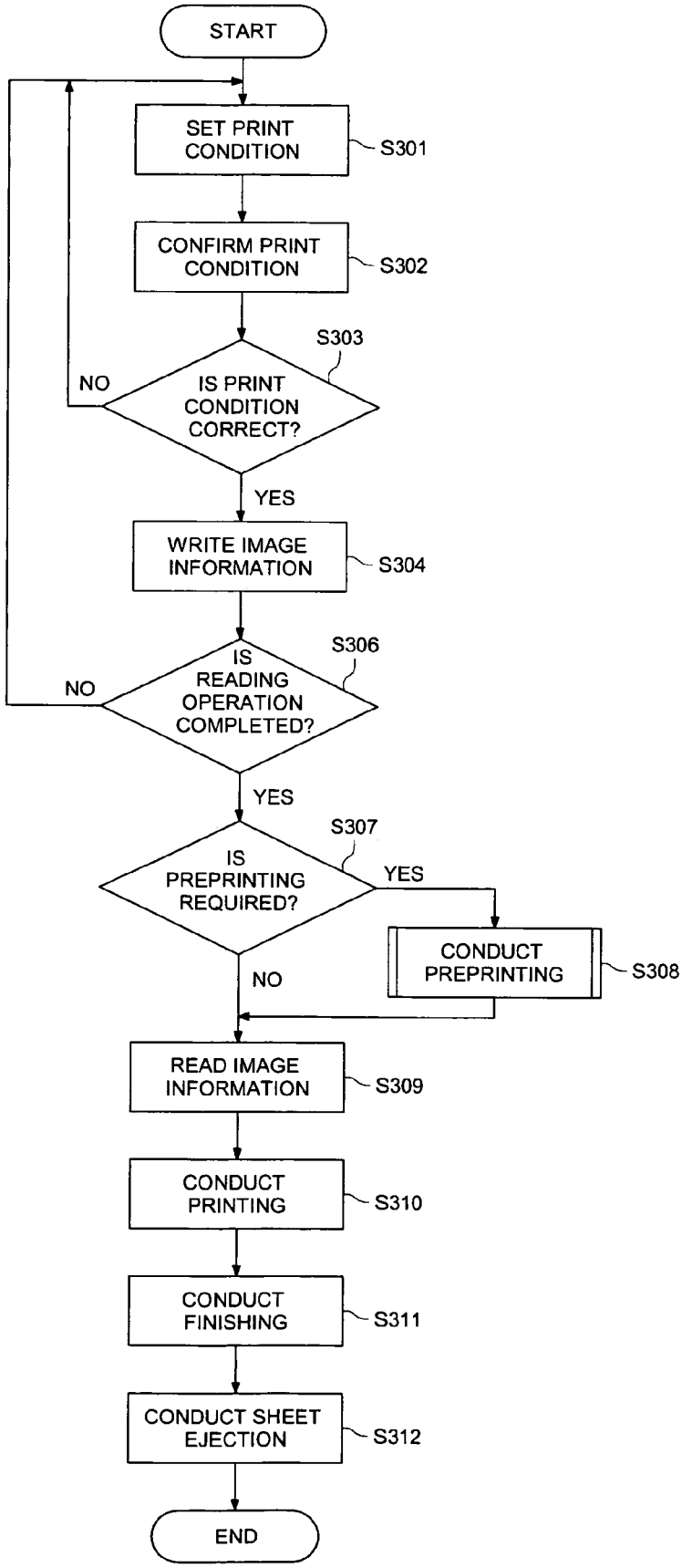
FIG. 4 is a flowchart showing the operation of an image forming apparatus.

Referring to FIG. 4, the operation of the digital multifunctional machine 100 of the present invention will be described. The operator selects the print condition input method, namely for each job, for a plurality of pages or for each page, from the operation section 108 equipped with a setting means. After that, the operator sets the print condition of the document (Step S301). In addition to the printer information such as document size, number of sheets to be printed and density, print condition such as finishing information including punching and stapling information is also set in this setting operation from the touch panel of the operation section 108 or ten-keypad. It should be noted that this setting operation also includes the setting of the process of finishing for each group and page. Thus, the print condition is complicated and wide-ranging.

FIGS. 5(A) and 5(B) show an example of the display screen of the operation section 108 for this setting. The display screen and ten-keypad 410 of FIGS. 5(A) and 5(B) provide setting means for checking and changing the print condition for each page. This display screen contains a bird's-eye view display 400 for providing a bird's-eye view of a plurality of documents for each inputted print condition, an individual display section 401 for displaying the print condition for each page of the document, and shift key 411. On the bird's-eye view display 400, image displays (layout plan) for symbolizing one document in one row for the number of all documents for which the setting is made, wherein they are arranged one on top of another in a displaced form. Here one document is represented by one rectangular form. Further, the print condition for each page of the document corresponding to the selected layout plan of the bird's-eye view display 400 are arranged on the individual display section 401. The layout plan as a symbol of one document is selected according to the page designation by the ten-keypad 410 or by the shift operation using the shift key 411 on the right top of the display screen. It should be added that the layout plan as a symbol of one document on the bird's-eye view display 400 is represented differently for each of the layout plans corresponding to the document containing different print conditions. For example, they are represented by different colors or crosshatches.

After the image information has been read from the scanner section 102, the display screen as a means for the aforementioned setting can be used to check and change the print condition. In this case, the image with the output document configured in a reduced form is given in a thumbnail display on the left of the individual display section 401, so that the operator can easily check the output document.

FIG. 5(A) shows an example of the individual display of the second page when scanning and printing 12 documents. In this example, the process of stapling is performed on pages 3 through 7, and the corresponding layout plan is shown crosshatched. FIG. 5(B) shows the same example as FIG. 5(A), and shows an example of the individual display of the third page when scanning and printing 12 documents. In this example, the process of stapling is carried out on pages 3 through 7, so a drawing schematically showing the process of stapling is added to the image for thumbnail display 404.

Going back to FIG. 4, the operator checks the print condition that has been inputted (Step S303). This checking is required to ensure correct outputting especially when the print condition is complicated and wide-ranging. Using the setting means shown in FIGS. 5(A) and 5(B), the operator determines if the print condition is correct or not (Step S303). If the print condition is not correct (No in Step S303), the system goes to Step S301 and the operator sets the print condition again.

Further, when the print condition is correct (Yes in Step S303), the operator places documents on the scanner section 102 so that the image information is read and written into the image memory 106 (Step S304). In this step of writing, the print condition inputted for each job, for a plurality of pages or for each page, as each print condition for each piece of image information, is linked with the compressed data of the image information, using the page writing means 201 shown in FIG. 1. Then it is stored in the image memory 106.

After that, the control section 161 checks whether or not reading has been completed the specified number of times (Step S306). If not (No in Step S306), the system goes to Step S301 and the print condition of the Step S301 is set.

When reading has been completed the specified number of times (Yes in Step S306), the control section 161, a check is made according to the information inputted from the operation section 108 (Step S307) to see if preprinting is required or not. In this case, when preprinting is required (Yes in Step S307), preprinting is performed (Step S308). If preprinting is not required (No in Step S307), a series of image information is read by reading the compressed data of the image memory 106 and each print condition (Step S309).

Figure 9:
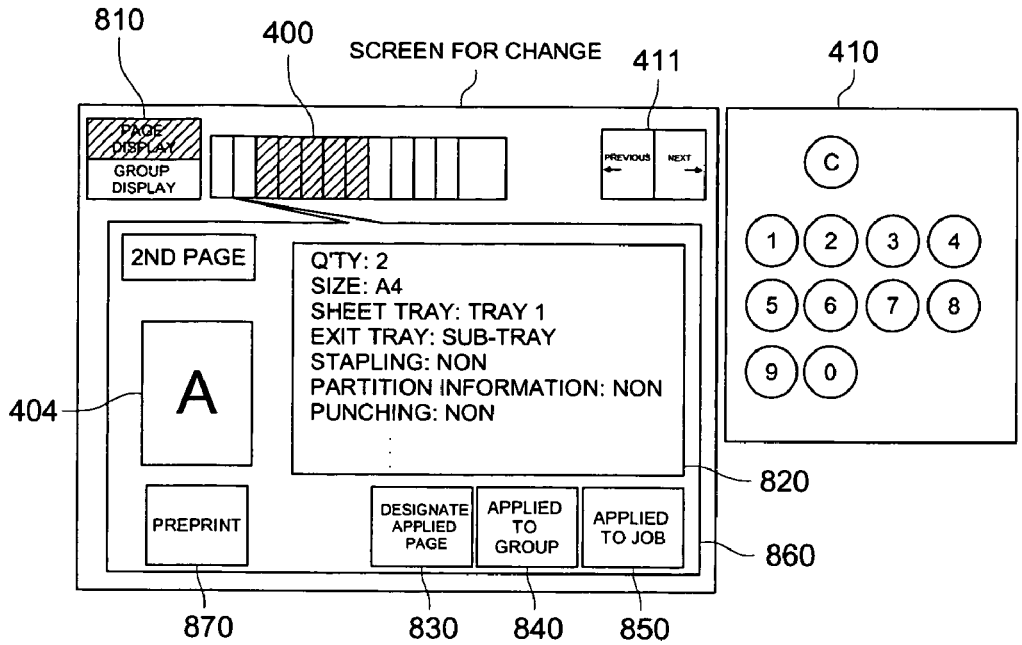
FIGS. 9(A) and 9(B) are drawings of a change screen for changing the print condition for each page as an embodiment of the present invention.
Figure 9:
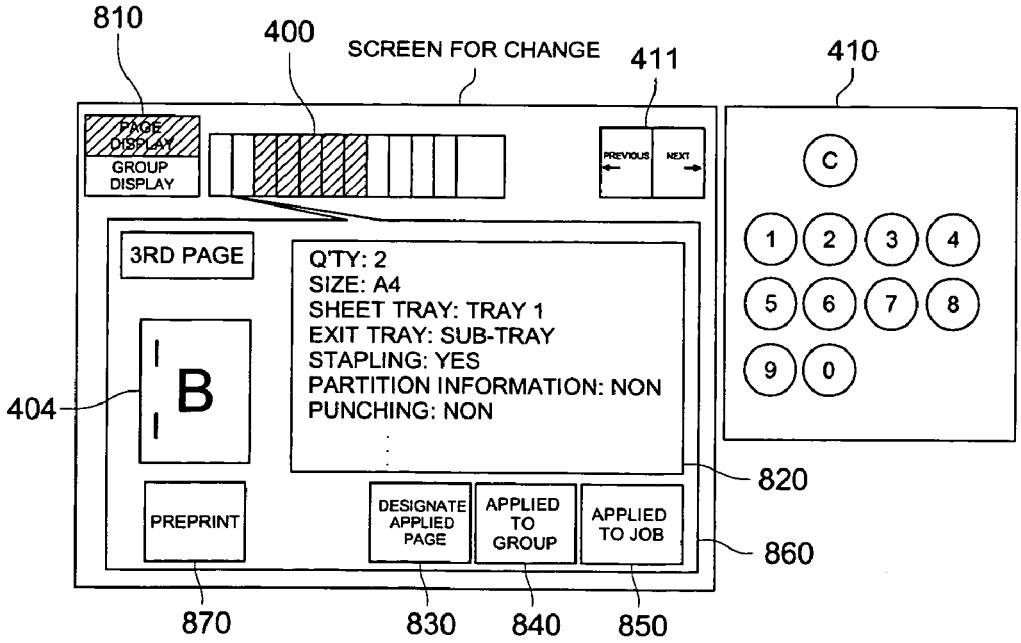

Incidentally, preprint designation is provided by pressing the preprint button 870 shown in FIGS. 9(A) and 9(B).

Process of preprinting in Step S308 will be described later.

When reading the image information in Step S309, the compressed data and each print condition linked with this compressed data are read sequentially, using the page reading means 202 shown in FIG. 1. The compressed data is expanded, and as image information, is then sent to the printer section 103, together with each print condition.

Based on each print condition, the printer control section 118 of the printer section 103 performs the process of printing the image information (Step S310) for each page. Since each print condition also includes finishing information, the punching unit 110 and the finishing apparatus 120 perform the process of finishing, based on the finishing information contained in the print condition from the printer control section 118 (Step S311), and eject the recording paper to the exit tray (Step S312). All steps in this processing terminate.

The following describes an example of each print condition sent from the image memory 106 to the printer section 103, an example of the finishing process carried out by the punching unit 110 and finishing apparatus 120 in Step S311, based on each of the print conditions, and an example of ejecting paper to the main tray 142 or sub-tray 144.

Figure 6:
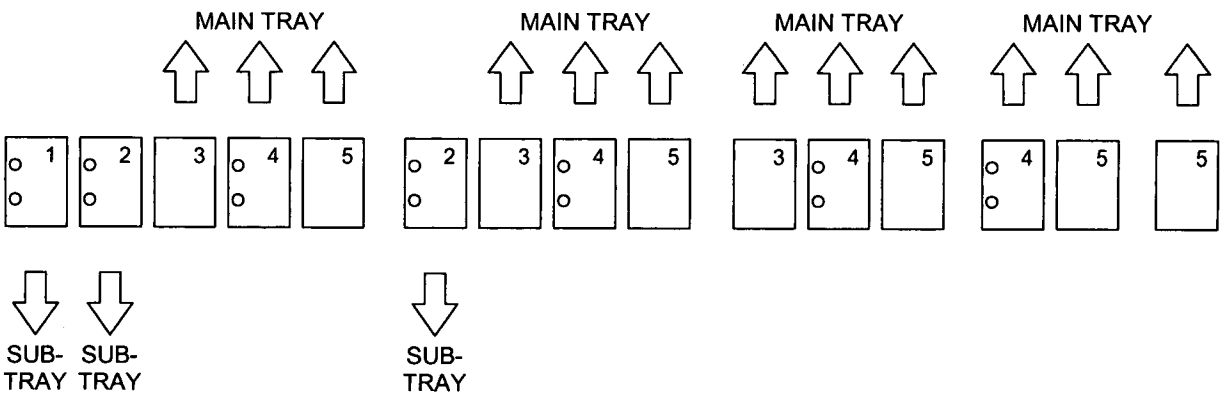
FIGS. 6(A) and 6(B) are drawings of an example of individual print condition of the input for each page as an embodiment of the present invention.

FIG. 6(A) shows an example of each print condition when the print condition is inputted for each page. The columns with an up-arrow mark have the same print condition as the upper columns. Each print condition corresponds to the example shown in the block diagram of FIG. 1. It is related to each print condition linked to the documents on pages 1 through 5. The vertical axis of the table indicates the page number and the horizontal axis indicates the print condition for each item. In this case, the finishing item, exit tray selection, number of volumes and partition information are given for each page as each print condition. The partition information is used, for example, as the partition information in the case of processing for each booklet. FIG. 6(B) shows an example of the recording paper outputted when paper has been ejected based on each print condition of FIG. 6(A). In FIG. 6(B), the recording paper of the number of volumes shown on each page is outputted to the designated main tray 142 or sub-tray 144, and punching operation is performed by the punching unit 110 on the designated page.

Figure 7:
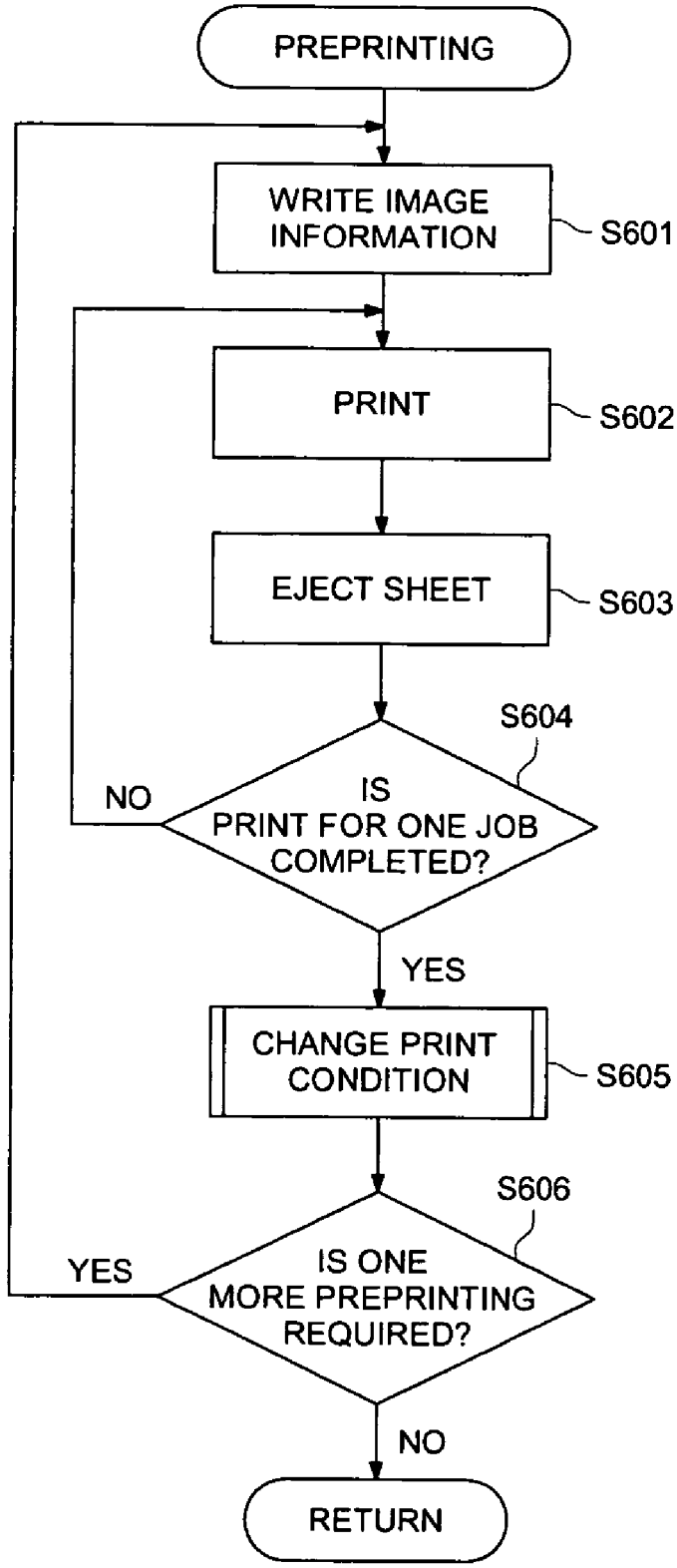
FIG. 7 is a flowchart representing the operation of preprint means as an embodiment of the present invention.

Referring to FIG. 7, the following describes the process of preprinting: FIG. 7 is a flowchart showing the operation of preprinting. The control section 161 allows the image information of one job to be picked up by the pickup means 203 (Step S601).

The control section 161 sends the image information for one job and each print condition to the printer section 103, where printing is performed (Step S602). After finishing such as punching and stapling has been conducted, paper is ejected to the exit tray (Step S603). The control section 161 checks whether or not printing and ejection have been completed for one job (Step S604). If not (No in Step S604), the system goes to Step S602 and printing is repeated. If printing and ejection for one job have been completed (Yes in Step S604), the control section 161 changes the print condition (Step S605). In this process of changing, the print output for one job is checked by the operator. If there is any problem, the print condition is changed. The process of changing will be described later.

Depending on the degree of change, the operator determines whether or not preprinting is repeated (Step S606). If printing is to be repeated (Yes in Step S606), the system proceeds to Step S601 to repeat preprinting. If preprinting is not required (No in Step S606), the system terminates the process of preprinting and goes to the Step S309 in FIG. 4, where normal printing of outputs is carried out.

Figure 8:
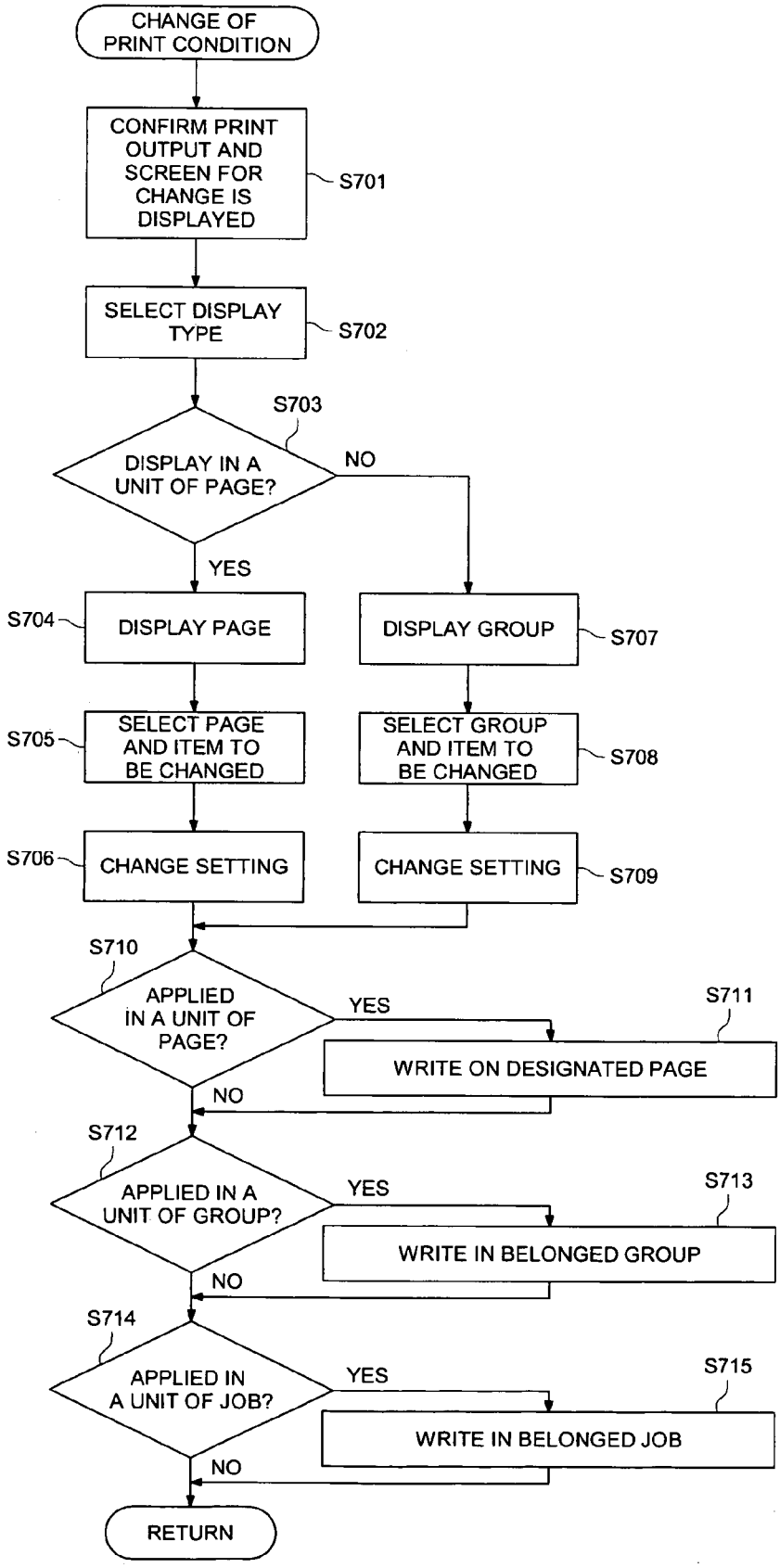
FIG. 8 is a flowchart representing the operation of change processing as an embodiment of the present invention.

Referring to FIG. 8, the process of changing in Step S605 will be described. FIG. 8 is a flowchart showing the operation in the process of change. Based on the preprinted output, a check is made to see whether the printed output is correct or not. After termination of preprinting, the control section 161 automatically proceeds to the preprinting change screen (Step S701).

The following describes the change screen of the operation section 108 with reference to FIGS. 9(A) and 9(B), and FIGS. 10(A) and 10(B). FIGS. 9(A) and 9(B), and FIGS. 10(A) and 10(B) show an example of the change screen for preprinting. This change screen is similar to the display screen for initial setting shown in FIGS. 5(A) and 5(B). To avoid duplication, the following description mainly refers to the differences, and the same portions will not be described. The change screen includes a switching means 810 for selecting the display format, a bird's-eye view display 400, a shift key 411 as a shift means, and an individual display section 860. The individual display section 860 contains a thumbnail display section 404, a print condition display section 820, a page application means 830, a group application means 840 and a job application means 850. The individual display section 860 corresponds to the individual display section 401 shown in FIGS. 5(A) and 5(B).

The switching means 810 is a selector switch for selecting whether the page-based print condition is displayed for each page on the print condition display section 820, or the group-based print condition is displayed for each group. FIGS. 9(A) and 9(B) show examples where the page display is selected by the switching means 810. FIGS. 10(A) and 10(B) show examples where group display is selected by the switching means 810. The print condition display section 820 of individual display section 860 indicates the print condition of one or more pages displayed on the left top of the individual display section 860. This display section is identically the same as the page-based print condition 403 and 405 shown in FIGS. 5(A) and 5(B). It is designed as a touch key. If the print condition item displayed is touched, the input screen of the selected item appears to permit setting.

The page application means 830 is a touch button. If this button is touched, the page-designated screen (not illustrated) appears so that the page can be designated. The page application means 830 sends this page information and the setting information of the item displayed on the print condition display section 820, to the page change means of the display and change means 205. Using the page writing means 201, the page application means 830 stores such information into the image memory 106 in a form associated with the image information for each page.

The group application means 840 is a touch button. The group of the print condition displayed on the change screen can be designated by touching this button. The group application means 840 sends this group designation information and setting information of the item displayed on the print condition display section 820, to the group change means of the display and change means 205. Using the page writing means 201, the group application means 840 stores such information into the image memory 106 in a form associated with the image information for each page. As shown in FIGS. 10(A) and 10(B), when the group display is selected by the switching means 810, the group application means 840 is maintained in a masked state where input operation is disabled.

The job application means 850 is a touch button. The job of the print condition displayed on the change screen can be designated by touching this button. The job application means 850 sends this job designation information and setting information of the item displayed on the print condition display section 820, to the job change means of the display and change means 205. Using the page writing means 201, the job application means 850 stores such information into the image memory 106 in a form associated with the image information for each page.

In this case, FIGS. 9(A) and 9(B) show examples where the page display is selected by the switching means 810. FIG. 9(A) refers to the case where "STAPLE NON" is set on the second page, while FIG. 9(B) refers to the case where "STAPLE YES" is set on the third page. FIGS. 10(A) and 10(B) show the case where the group display is selected by the switching means 810. FIG. 10(A) refers to the case where "STAPLE NON" is set on the first and second pages, and FIG. 10(B) the case where "STAPLE YES" is set on the third through seventh pages.

The bird's-eye view display 400, shift key 411, thumbnail display section 404 and ten-keypad 410 have identically the same functions as those given in FIGS. 5(A) and 5(B). Here the bird's-eye view display 400 and shift key 411 allow page-based display and shift to be performed if the page display is selected by the switching means 810, and allow group-based display and shift to be performed if the group display is selected by the switching means 810.

Returning to FIG. 8, the operator selects the display format using the switching means 810 (Step S702). In this case, based on the error conditions of the printed output, the operator selects it by determining if the page to be changed is based on the page unit or group unit. The control section 161 allows the page display to be selected by the switching means 810 and determines whether or not the page-based display should be made (Step S703). If the page-based display is to be made (Yes in Step S703), the control section 161 provides a page display shown in FIGS. 9(A) and 9(B) (Step S704).

After that, according to the change screen shown in FIGS. 9(A) and 9(B), the operator selects the page and item to be changed; the operator selects the page by operating the shift key 411, and the item by touching the print condition display section 820 (Step S705). The operator then changes the settings using the setting change screen for each of the items (not illustrated) (Step S706).

When the page-based display is not required (No in Step S703), the control section 161 provides the group display as shown in FIGS. 10(A) and 10(B) (Step S707). According to the change screen of FIGS. 10(A) and 10(B), the operator selects the group and item to be changed; the operator selects the group by operating the shift key 411, and the item by touching the print condition display section 820 (Step S708). The operator then changes the settings using the setting change screen for each of the items (not illustrated) (Step S709).

After that, when storing the changed setting into the image memory 106 using the page writing means 201, the operator determines whether the designated unit of page is used or not (Step S710). In this case, if the unit of page is used (Yes in Step S710), the control section 161 designates the page on the page setting screen (not illustrated) and writes new print condition using the designated page writing means 201 (Step S711). If the unit of page is not used (No in Step S710), the operator goes to the next step without the Step S711 being performed.

When storing the changed setting into the image memory 106 using the page writing means 201, the operator determines whether the unit of group is used or not (Step S712). In this case, if the unit of group is used (Yes in Step S712), the control section 161 writes a new print condition into each of the pages of the group where this page belongs, using the designated page writing means 201 (Step S713). If the unit of group is not used (No in Step S712), the operator goes to the next step without the Step S713 being performed.

When storing the changed setting into the image memory 106 using the page writing means 201, the operator determines whether the unit of job is used or not (Step S714). In this case, if the unit of job is used (Yes in Step S714), the control section 161 writes a new print condition into each of the pages of the job where this page belongs, using the designated page writing means 201 (Step S715). If the unit of job is not used (No in Step S714), the operator terminates this processing without the Step S715 being performed.

FIGS. 11(A) through 14(B) show specific examples of change in the process of changing given in FIG. 8. The drawings of FIGS. 11(A) through 14(B) are the same as those shown in FIG. 6(A). Each print condition, designated in terms of the page number on the vertical axis and the item-based print condition on the horizontal axis, is shown in the worksheet. The columns with an up-arrow marks have the same print condition as the upper columns.

FIG. 11(A) shows an example of initial setting. This setting example includes the finishing-related items such as stapling, partition and punching, in addition to the setting items such as the number of volumes, paper size, sheet tray and exit tray. In this example, the process of stapling performed on the third through seventh pages, and partition information is added to indicate the end of stapling on the seventh page. Here the first and second pages where stapling is not performed, the third through seventh pages where stapling is performed, and the eighth through twelfth pages where stapling is not performed constitute groups 1 through 3, respectively. The first through twelfth pages constitute one job.

FIG. 11(B) shows an example of adding the process of punching on the second page, using the process of page-based changing after preprinting, with respect to the initial setting shown in FIG. 11(A). In this example, the page display of the switching means 810 is selected on the change screen shown in FIG. 9(A), and the second page is selected by the shift key 411. Punching is selected from the items of print condition display section 820. The setting information of this punching is present (Yes) and the second page is designated by the page application means 830.

FIG. 12(A) shows an example of adding the process of punching on the first through third pages, using the process of page-based changing after preprinting, with respect to the initial setting shown in FIG. 11(A). In this example, the page display of the switching means 810 is selected on the change screen shown in FIG. 9(A), and the second page is selected by the shift key 411. Punching is selected from the items of print condition display section 820. The setting information of this punching is present (Yes) and first through third pages is designated by the page application means 830.

FIG. 12(B) shows an example of adding the process of punching on the first and second pages (group 1), using the process of page-based changing after preprinting, with respect to the initial setting shown in FIG. 11(A). In this example, the page display of the switching means 810 is selected on the change screen shown in FIG. 9(A), and the second page is selected by the shift key 411. Punching is selected from the items of print condition display section 820. The setting information of this punching is present (Yes) and first and second pages are designated by the group application means 840.

FIG. 13(A) shows an example of adding the process of punching to the entire job, using the process of page-based changing after preprinting, with respect to the initial setting shown in FIG. 11(A). In this example, the page display of the switching means 810 is selected on the change screen shown in FIG. 9(A), and the second page is selected by the shift key 411. Punching is selected from the items of print condition display section 820. Punching is designated to the entire job by the job application means 850. In this case, the partition information showing the process of stapling performed on the third through seventh pages and the end of stapling on the seventh page reflects the entire setting information on the second page.

FIG. 13(B) shows an example of adding the process of punching for each group, using the process of group-based changing after preprinting, with respect to the initial setting shown in FIG. 11(A). In this example, the group display of the switching means 810 is selected on the change screen shown in FIG. 10(A), and the first and second pages are selected by the shift key 411. Punching is selected from the items of print condition display section 820. The setting information of this punching is present (Yes), and punching is designated to the entire group 1 by the group application means 840.

FIG. 14(A) shows an example of adding the process of punching for each group or for each designated page, using the process of group-based changing after preprinting, with respect to the initial setting shown in FIG. 11(A). In this example, the group display of the switching means 810 is selected on the change screen shown in FIG. 10(A), and the first and second pages are selected by the shift key 411. Punching is selected from the items of print condition display section 820. The setting information of this punching is present (Yes), and punching is designated to the entire group 1 on the first and second page by the group application means 840. Further, eleventh and twelfth pages are designated by the page application means 830.

FIG. 14(B) shows an example of adding the process of punching for each group or for each job, using the process of group-based changing after preprinting, with respect to the initial setting shown in FIG. 11(A). In this example, the group display of the switching means 810 is selected on the change screen shown in FIG. 10(A), and the first and second pages are selected by the shift key 411. Punching is selected from the items of print condition display section 820. The setting information of this punching is present (Yes), and punching is designated to the job by the job application means 850. In this case, the entire setting information on the first and second pages is reflected to the entire job, therefore, stapling is not performed.

Figure 15:
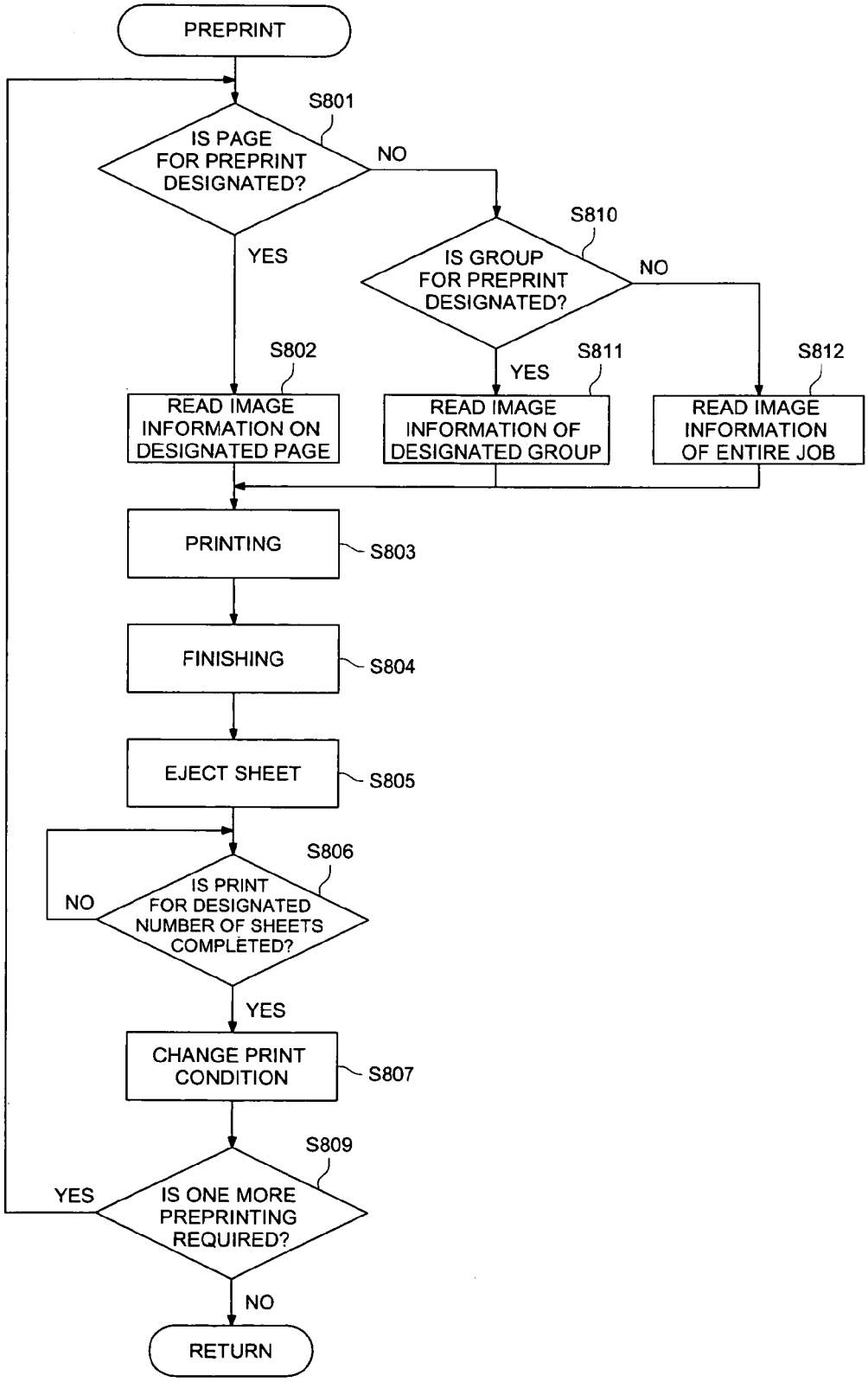
FIG. 15 is a flowchart representing the operation as a variation of preprint processing.

Referring to FIG. 15, the following describes a variation of preprinting in the Step 308 of FIG. 4.

The control section 161 judges whether the page for preprinting has been designated or not (Step S801). If no page for preprinting has been designated according to the decision of the Step S801, the control section 161 judges whether the group for preprinting has been designated or not (Step S810). If no group has been designated according to the decision of the Step S810, the control section 161 sends the image information and each print condition for one job, to the printer section 103 (Step S812), where the process of printing is carries out (Step S803). If the group for preprinting has been designated according to the decision of the Step S810, the control section 161 sends the image information of the designated group and the print condition of the designated group to the printer section 103 (Step S811), where the process of printing is carries out (Step S803). Further, if the page for preprinting has been designated according to the decision of the Step S802, the control section 161 sends the image information of the designated page and the print condition of the designated page to the printer section 103 (Step S802), where the process of printing is carries out (Step S803).

To designate the page for preprinting, press the preprint button 870 of FIGS. 9(A) and 9(B), then the applied page designation button 830. This procedure starts preprinting of the designated page having been selected. To designate the group for preprinting, press the preprint button 870 of FIGS. 9(A) and 9(B), then the applied group designation button 840. This procedure starts preprinting of the designated group having been selected. To start preprinting for the overall job, press the preprint button 870, then the applied job designation button 850.

After that, finishing is performed in conformity to the print condition (Step S804) and paper is ejected (Step S805).

A check is made to see whether the designated printing having been determined in Steps S801 and S810 has been completed or not (Step S806). If it has not been completed, the print condition is changed (Step S807). The procedure for changing this condition is the same as that in FIG. 8, and will not be described to avoid duplication.

A check is made again to see whether the preprint button 870 has been pressed or not (Step S809). If it has been pressed, the system goes back to the Step S801. Again, if the preprint button 870 is not pressed, the process of preprinting is terminated. The system goes to the Step S309 of FIG. 4, where the printed output is produced in the normal print mode.

As described above, in the present embodiment, when the print condition is changed after preprinting, the page to be changed is selected and display for each page or for each group. After the displayed print condition has been changed, the page-based each print condition is created using the display and change means 205 for each designated page, group or job, and is stored in the image memory 106. This arrangement effectively changes the setting of for only the page containing a setting error checked in preprinting. When each print condition is stored in the image memory 106, this arrangement ensures the optimum range of application for each page, group or job, thereby reducing the labor and time in setting and minimizing the setting error.

In the present embodiment, the finishing section constituted by the finishing apparatus 120 and punching unit 110 is used. It is also possible to use such a finishing section as a sorter for sorting the recording paper.

In the present embodiment, preprinting for image formation is carried out by the preprinting and the print condition of the page to be changed, selected out of plural pages is displayed and changed by the display and change means, upon completion of the preprinting. Then the selection and change are set by the operation section. This arrangement enables simple resetting to be done, without requiring labor and time, and reduces resetting errors.

Also, according to the present embodiment, as plural pages having the same print conditions are selected as one group, contents of the changes in the print conditions for the group is inputted, and the print conditions for the aforementioned selected page are changed, based on the contents of the aforementioned changes.

This arrangement ensures simple resetting without requiring much labor and time for changing, and minimizes resetting errors.

Also, the operation section uses the switching section to switch whether the aforementioned selection is carried out for each page or for each group having the same print condition. This arrangement provides a unit ensuring easy change in response to a particular setting error.

Also, the operation section uses a shift section to shift the aforementioned selection for each page or group mentioned above. This arrangement provides an easy selection of desired page or group.

In the present embodiment, the display and change means uses the page change section to change the designated page and to store the result. Thus, the print condition can be changed for each page.

According to the present embodiment, the operation section uses the page application section to designate one or plural pages. This allows the page change section to be operated.

Also, the display and change means uses the group change section to change the group and store the result. Thus, the print condition to be stored can be changed for each group.

In the present embodiment, the operation section uses the group change section to designate the group. This allows the group change section to be operated.

Also, the display and change means uses the job change section to change the job and to store the result. Thus, the print condition to be stored can be changed for each job.

According to the present embodiment, the operation section uses the job application section to designate the job. This allows the job change section to be operated.

Also, the preprint means preprints one job. This permits all page setting to be confirmed.

What is claimed is:

1. An image forming apparatus for forming an image based on image information on a recording medium, comprising:

(a) a storage section for storing a print condition for each of a plurality of pages of image information;

(b) a print condition setting section for setting a print condition in response to the print condition stored in the storage section;

(c) a preprint section for preprinting in accordance with the print condition which has been set;

(d) an input section for inputting contents of a change in the print condition for a page to be changed, selected from the plurality of pages after the preprinting; and (e) a change section for changing a setting of the print condition for the selected page to be changed, based on the contents of the change.

2. The image forming apparatus of claim 1, further comprising an output section for outputting data for displaying the print condition of the page to be changed, after the preprinting.

3. The image forming apparatus of claim 1, further comprising a display section for displaying the print condition of the page to be changed, after the preprinting.

4. The image forming apparatus of claim 1, further comprising a switching section for switching between a selection to be performed for each page and a selection to be performed for each group containing plural pages having a same print condition.

5. The image forming apparatus of claim 1, further comprising an operation section for selecting the page to be changed out of the plurality of pages, and for inputting the contents of the change of the print condition of the page to be changed.

6. The image forming apparatus of claim 5, further comprising a switching section for switching between a selection to be performed for each page and a selection to be performed for each group containing plural pages having a same print condition.

7. The image forming apparatus of claim 6, further comprising a shift section for shifting the selection for each page or for each said group.

8. The image forming apparatus of claim 1, wherein the change section applies the change to a single page or plural pages which have been designated.

9. The image forming apparatus of claim 8, further comprising an operation section for selecting the page to be changed out of the plurality of pages, and for inputting the contents of the change of the print condition of the page to be changed, wherein the operation section has a page application section for designating the single page or the plural pages.

10. The image forming apparatus of claim 1, wherein the change section applies the change to a group containing plural pages having a same print condition.

11. The image forming apparatus of claim 10, further comprising an operation section for selecting the page to be changed out of the plurality of pages, and for inputting the contents of the change of the print condition of the page to be changed, wherein the operation section has a group application section for designating the group.

12. The image forming apparatus of claim 1, wherein the change section comprises a job application section for applying the change to a job including plural pages.

13. The image forming apparatus of claim 12, further comprising an operation section for selecting the page to be changed out of the plurality of pages, and for inputting the contents of the change of the print condition of the page to be changed, wherein the operation section has a job designating section for designating the job to include the plural pages.

14. The image forming apparatus of claim 1, wherein the preprint section preprints one job including plural pages.

15. An image forming apparatus for forming an image based on image information on a recording medium, including:

(a) a storage section for storing a print condition for each of a plurality of pages of image information;

(b) a print condition setting section for setting a print condition in accordance with the print condition stored in the storage section;

(c) a selection section for selecting plural pages each having a same print condition as one group from among the plurality of pages, wherein the plurality of pages includes at least one page having a print condition different from the same print condition of the group;

(d) an input section for inputting contents of a change in the print condition for the group selected by the selection section; and (e) a change section for changing a setting of the print condition for the selected group, based on the change.

16. An image forming apparatus for forming an image based on image information on a recording medium, including:

(a) a storage section for storing a print condition for each of a plurality of pages of image information;

(b) a print condition setting section for setting a print condition in accordance with the print condition stored in the storage section;

(c) a selection section for selecting plural pages having a same print condition as one group;

(d) an input section for inputting contents of a change in the print condition for the group selected by the selection section;

(e) a change section for changing a setting of the print condition for the selected group, based on the change; and (f) a switching section for switching between a selection to be performed for each page and a selection to be performed for the group containing the plural pages having the same print condition.

17. An image forming apparatus for forming an image based on image information on a recording medium, including:

(a) a storage section for storing a print condition for each of a plurality of pages of image information;

(b) a print condition setting section for setting a print condition in accordance with the print condition stored in the storage section;

(c) a selection section for selecting plural pages having a same print condition as one group;

(d) an input section for inputting contents of a change in the print condition for the group selected by the selection section;

(e) a change section for changing a setting of the print condition for the selected group to be changed, based on the change; and (f) an operation section for selecting the page to be changed out of the plurality of pages, and for inputting the contents of the change of the print condition of the page to be changed.

18. The image forming apparatus of claim 17, further comprising a switching section for switching between a selection to be performed for each page and a selection to be performed for the group containing the plural pages having the same print condition.

19. The image forming apparatus of claim 18, further comprising a shift section for shifting the selection for each page or for each said group.

20. The image forming apparatus of claim 19, further comprising an operation section for selecting the page to be changed out of the plurality of pages, and for inputting the contents of the change of the print condition of the page to be changed, wherein the operation section has a page application section for designating plural pages.

21. An image forming apparatus for forming an image based on image information on a recording medium, including:

(a) a storage section for storing a print condition for each of a plurality of pages of image information;

(b) a print condition setting section for setting a print condition in accordance with the print condition stored in the storage section;

(c) a selection section for selecting plural pages having a same print condition as one group;

(d) an input section for inputting contents of a change in the print condition for the group selected by the selection section;

(e) a change section for changing a setting of the print condition for the selected group to be changed, based on the change, wherein the change section has a job application section for applying the change to a job including plural pages; and (f) an operation section for selecting the page to be changed out of the plurality of pages, and for inputting the contents of the change of the print condition of the page to be changed, wherein the operation section has a job designating section for designating the job to include the plural pages.

* * * * *